US005499603A

United States Patent [19]

Vinokur

[11] Patent Number: 5,499,603

[45] Date of Patent: Mar. 19, 1996

[54] LIQUID INJECTION SYSTEM FOR INTERNAL COMBUSTION ENGINE

[76] Inventor: Michael Vinokur, 5 Fisherville Road, Unit #509, North York, Ontario, Canada, M2R 3B6

[21] Appl. No.: 144,083

[22] Filed: Oct. 27, 1993

[51] Int. Cl.[6] ..... F02B 47/00; B01F 5/04

[52] U.S. Cl. ..... 123/25 E; 239/87; 137/897; 366/167.1

[58] Field of Search ..... 123/585, 25 E; 239/87, 548, 549; 137/896, 897; 366/167, 176

[56] References Cited

U.S. PATENT DOCUMENTS 4,566,634 11/1986 Wiegand ..... 123/585
4,570,598 2/1986 Samson et al. ..... 123/585
4,776,516 10/1988 Klomp ..... 239/87
5,113;837 5/1992 Faull ..... 123/585
5,199,386 4/1993 Hubbard ..... 123/25 E
5,207,383 5/1993 Hans et al. ..... 123/585
5,255,658 10/1993 Hoffer et al. ..... 123/585
5,269,283 12/1993 Thompson ..... 123/585

*Primary Examiner*—Erick R. Solis
*Attorney, Agent, or Firm*—Caesar, Rivise, Bernstein Cohen & Pokotilow, Ltd.

[57] ABSTRACT

A liquid injection system for internal combustion engines has a simplified pumping system, with a vacuum driven pump, assisted by an electrically driven booster pump. The liquid is delivered to the engine manifold by way of a spray nozzle incorporating an expansion chamber, into which chamber a calibrated air nozzle delivers air as a high velocity jet to impinge in atomizing, droplet forming relation on injection liquid entering the expansion chamber.

13 Claims, 5 Drawing Sheets

LIQUID INJECTION SYSTEM FOR INTERNAL COMBUSTION ENGINE

TECHNICAL FIELD

This invention is directed to a liquid injection system, and in particular to a water injection system for use with internal combustion engines.

BACKGROUND ART

Internal combustion engines are notorious for polluting the atmosphere, both by the emission of pollutants, and by emitting hot gases that contribute to the warming up of earth's atmosphere.

These polluting gases include carbon monoxide, carbon dioxide and nitrous oxides. Many efforts have been and are being made to modify the extent of such pollution. One such effort involves the injection of water with the fuel, which can have a number of beneficial effects. These effects include: increased fuel efficiency, thereby diminishing overall fuel consumption, to conserve hydrocarbon fuels and to diminish atmospheric heat loading; and enhanced combustion characteristics, by diminishment of the production of carbon monoxide and nitrous oxides.

My earlier patent, U.S. Pat. No. 4,461,245 of Jul. 24, 1984, shows such a water injecting system. This earlier system incorporates a complex dual diaphragm vacuum-driven pump, with check valves, an air chamber, and solenoid assist, combined with a pressure responsive injection nozzle.

Prior to my above-identified system other systems included an electronic controller for a pump injecting a water spray into the carburetor airstream of an engine. The controller responds to a predetermined minimum engine speed to start the pump so as to operate upon the occurrence of negative back pressure in the engine manifold.

In U.S. Pat. No. 2,756,729, issued July 1956, Wolcott, a double diaphragm regulating valve regulates water flow as a function of manifold negative back pressure.

In U.S. Pat. No. 3,845,745, a water injection system is responsive to positive pressure in the engine manifold, with higher specific water consumption at low loads than at higher loads and with unpredictable results for different sizes of engine.

These earlier systems are complex, expensive and somewhat ineffective.

DISCLOSURE OF THE INVENTION

In accordance with the present invention there is provided a liquid injection control system having spray nozzle means for the passage of injection liquid therethrough, the spray nozzle means having a liquid inlet, a sized orifice for the passage of injection liquid therethrough, an outlet for the injection liquid downstream therefrom; and an expansion chamber located intermediate the metering orifice and the outlet. In this improved system an air nozzle is provided having an atmospheric inlet located outside the expansion chamber and an outlet, located within the expansion chamber, the main (polar) axis of the air nozzle being inclined from the main (polar) axis of the expansion chamber, whereby, in use, air leaving the air nozzle impinges upon liquid leaving the metering orifice, in atomizing, droplet forming impacting relation therewith.

The present invention further provides the aforesaid spray nozzle means with a variable by-pass valve means for passage of a portion of the incoming injection liquid in by-pass flow relation with the sized orifice.

This variable by-pass valve means includes a spring loaded variable orifice responsive to the pressure of the injection liquid at the liquid inlet to the spray nozzle means.

In the preferred embodiment the by-pass valve means has an annular valve seat, a substantially cylindrical valve body having a projecting annular collar portion in seated sealing relation with the valve seat, and spring means regulating displacement of the valve body from off the annular seat in response to the force acting on the valve body due to the fluid pressure differential acting thereupon.

In this embodiment, the aforesaid sized injection liquid orifice is located on the main axis of the cylindrical valve body and in substantially co-planar relation with the collar portion of the cylindrical valve body, and forms a part of the valve body. The main flow of the injection liquid passes axially through the open cylindrical body of the by-pass valve.

On one side of the outer cylindrical surface of the cylindrical body of the by-pass valve there is an inwardly tapered, axially extending relieved surface that serves as a progressively opening by-pass flow passage.

In the preferred system embodiment the simplified liquid supply and pumping arrangement comprises a liquid reservoir; a vacuum driven pump energized from the engine intake manifold, to pump liquid from the reservoir to the engine; an electrically driven booster pump for priming the vacuum pump, and for boosting the input of liquid to the vacuum pump; and, a solenoid actuated flow control valve for controlling the passage of liquid from the booster pump to the vacuum pump, and from the vacuum pump to the spray nozzle.

In the preferred embodiment of the spray nozzle means the polar axis of the air nozzle is at 90 degrees to the polar axis of the expansion chamber and its liquid inlet. Also, the air nozzle outlet is located adjacent the downstream side of the liquid metering orifice, to impact and atomize a jet of liquid coming from the orifice.

In the operation of the spray nozzle means, the effect of increasing pressure in the liquid supplied to the spray nozzle means modified by decreased vacuum in the engine induction manifold displaces the movable by-pass nozzle from off the by-pass valve seat, thereby opening the valve as a by-pass flow path, to permit complementary flow of liquid into the expansion chamber of the device in addition to the flow of liquid through the movable nozzle under increased load conditions of the engine. Under such increased load, the by-pass flow path being of tapered section, as the displacement of the movable nozzle increases due to increase in the inlet pressure of the liquid, as modified by the decrease in engine manifold pressure, so the flow section of the by-pass path increases, thereby permitting increased by-pass flow of liquid to complement the liquid flow through the nozzle.

The axially directed liquid flow path through the spray nozzle expansion chamber is intersected by the laterally directed air nozzle, upstream of the chamber outlet. The size of the air nozzle, which has a sized aperture adjacent its outlet into the expansion chamber, is predicated upon the rating of the engine. The air nozzle outlet is sharp edged, in order to achieve maximum mixing impact with the liquid discharging adjacent thereto, from the movable nozzle, with the intent of achieving a high degree of atomization of the liquid.

Use of the present system has been made to control admission of water as the liquid admitted to the intake manifold of an automotive engine.

The air nozzle may be fitted to the outer casing of the spray nozzle means, as a push fit into the wall of the expansion chamber. With the provision of a range of sizes of air nozzles, it is possible to readily select the air nozzle best suited to the size and power rating of the engine.

A further characteristic of the present invention is the use of a greatly simplified liquid pumping means comprising a vacuum assisted pump in combination with an electrically driven booster pump.

In contrast to my earlier system, the vacuum assisted pump is without solenoid, and is valveless, having a single diaphragm by which suction from the engine manifold is applied to one side of the diaphragm to draw the diaphragm down against its return spring, to create a pressure drop on the reverse side of the diaphragm and its associated induction chamber. This induces an inlet flow of liquid from the water tank into the vacuum assisted pump.

The liquid passes through an electrical booster pump to the induction chamber, by way of a three-way solenoid valve, the state of which is controlled by electrical contacts located in the vacuum assisted pump.

When the diaphragm of the vacuum assisted pump is in its uppermost position (water depleted) first electrical contacts in the vacuum assisted pump are closed, to energize the electrical booster pump, and to switch the solenoid valve to a position interconnecting the liquid output of the booster pump to the vacuum assisted pump. When the diaphragm of the vacuum assisted pump is in its lowermost (water-filled) position, the first electrical contacts are opened, and second electrical contacts closed, to switch the solenoid valve to a position interconnecting the inlet/outlet of the vacuum assisted pump to the spray nozzle means.

Thus upon filling of the pump induction chamber with water, return displacement of the pump diaphragm under the action of the pump return spring serves to pressurize the water, with return outflow through the solenoid valve, which diverts the pressurized water to the spray nozzle means, for injection into the engine.

When the engine is shut down the water in the system is returned to the reservoir, by the action of the spring of the diaphragm pump, the solenoid valve in its then de-energised state connecting the diaphragm pump inlet/outlet back through the electric booster pump to the reservoir.

BRIEF DESCRIPTION OF THE DRAWINGS

Certain embodiments of the invention are described by way of illustration, without limitation of the invention to such embodiments, reference being made to the accompanying drawings, wherein.

DETAILED DESCRIPTION OF THE INVENTION

Figure 1:
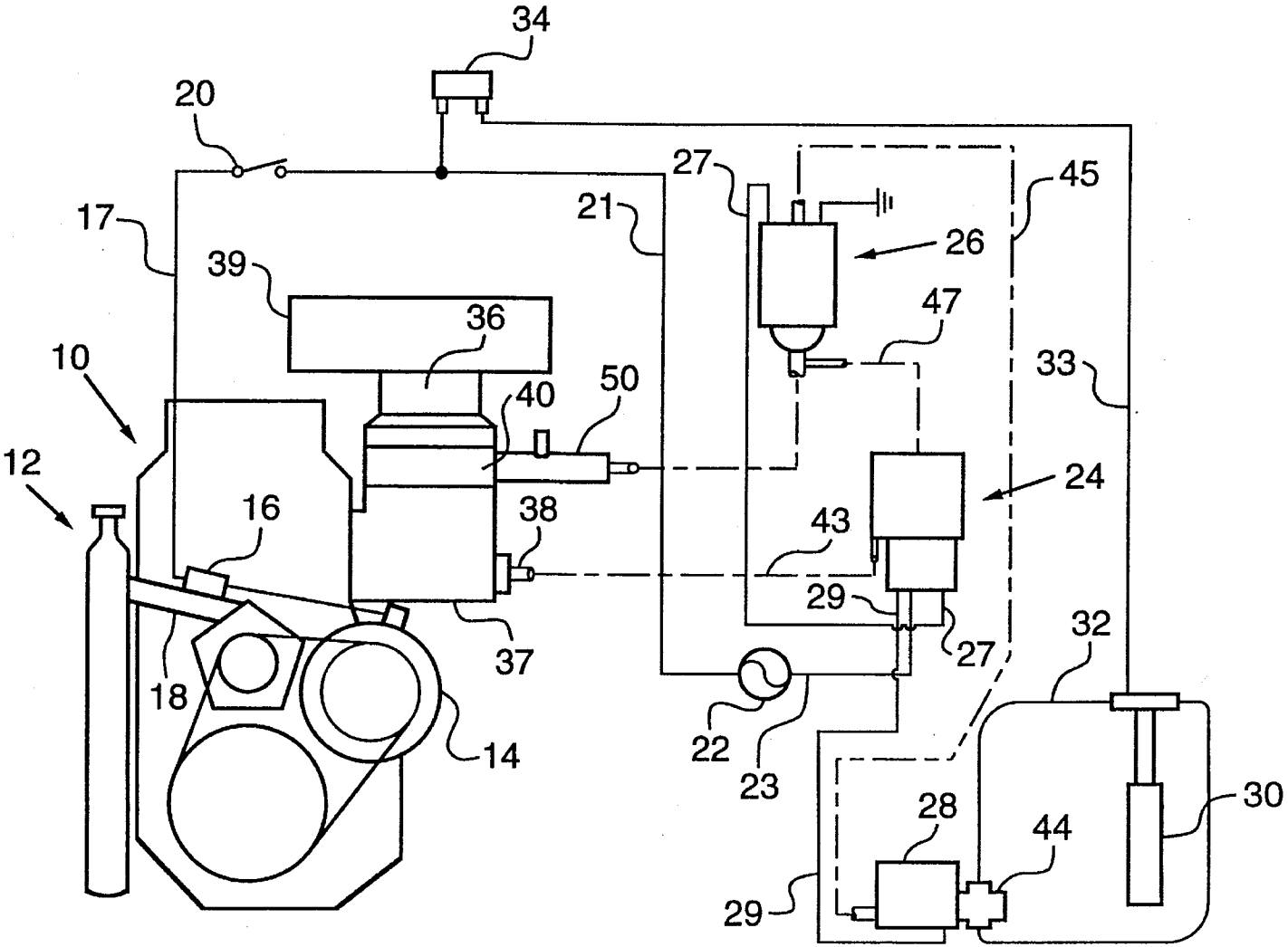
FIG. 1 is a diagramatic representation of an automotive type engine having a water injection system in accordance with the present invention incorporated therewith.

Referring to the schematic FIG. 1, an automotive engine 10 has a radiator 12 (shown in side view). Dealing first with the electrical circuit for the system, a belt driven alternator 14 connects with a thermal switch 16, mounted upon radiator return hose 18. The switch 16 is connected in series by way of conductor 17 to the system on/off switch 20, which connects by conductor 21 to over-current protection fuse 22, which connects by conductor 23 to the vacuum pump 24 of the water injection system.

A three-way solenoid valve 26 is connected by conductor 27 to the vacuum pump 24.

An electrical water pump 28 is connected by conductor 29 to a switch 94 (FIG. 3) located in the vacuum pump 24.

A float level sensor 30 located in injection water tank 32 is connected by conductor 33 to the output side of switch 20, by way of low level alarm buzzer 34.

Turning to the other aspects of the system, engine 10 has carburetor 36 mounted on intake manifold 37 and surmounted by air filter 39. A spacer plate 40 is interposed between carburetor 36 and manifold 37.

A vacuum driven pump 24 is connected by vacuum line 43 to the engine manifold vacuum outlet 38.

The electrical pump 28 is connected through the wall of tank 32 to a filter 44, and delivers water or water/-anti-freeze mixture by way of line 45 to the inlet (top) side of solenoid valve 26.

A line 47 connects solenoid valve 26 to the water chamber 84 (FIG. 3) of vacuum pump 24.

A line 49 connects solenoid valve 26 to the spray nozzle means 50.

In operation, when vacuum pump 24 requires to be filled with water, solenoid valve 26 is de-energized to permit water flow from line 45 to enter line 47, to fill the water chamber of vacuum pump 24, while electrical pump 28 also is energized to provide positive water feed to line 45.

When vacuum pump 24 is discharging, the solenoid valve 26 is energized to permit flow of water from line 47 into line 49, and thus to the spray nozzle means 50.

Figure 2:
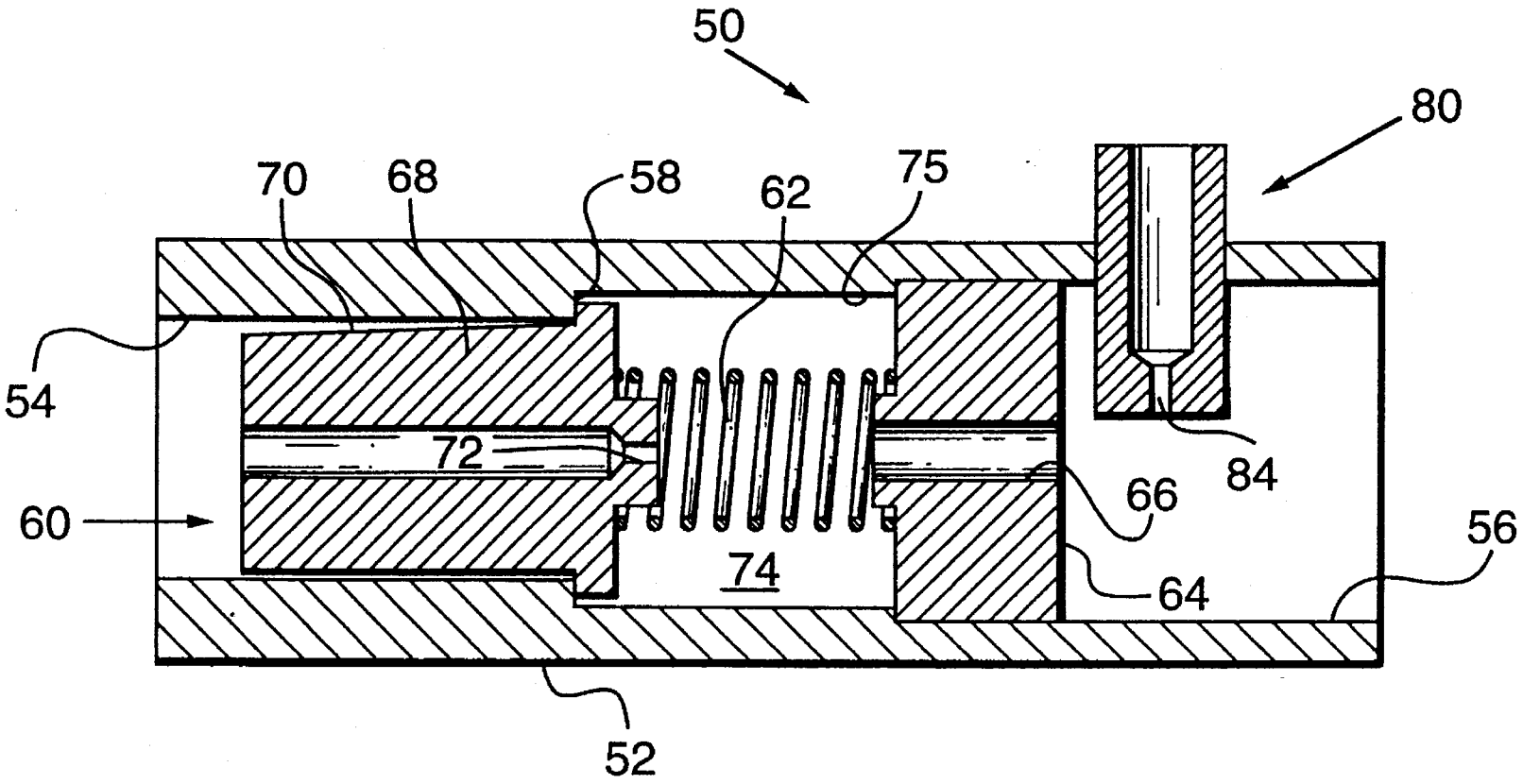
FIG. 2 is a side elevation view in diametrical cross-section of spray nozzle means according to the invention, having the liquid by-pass thereof closed.
Figure 4:
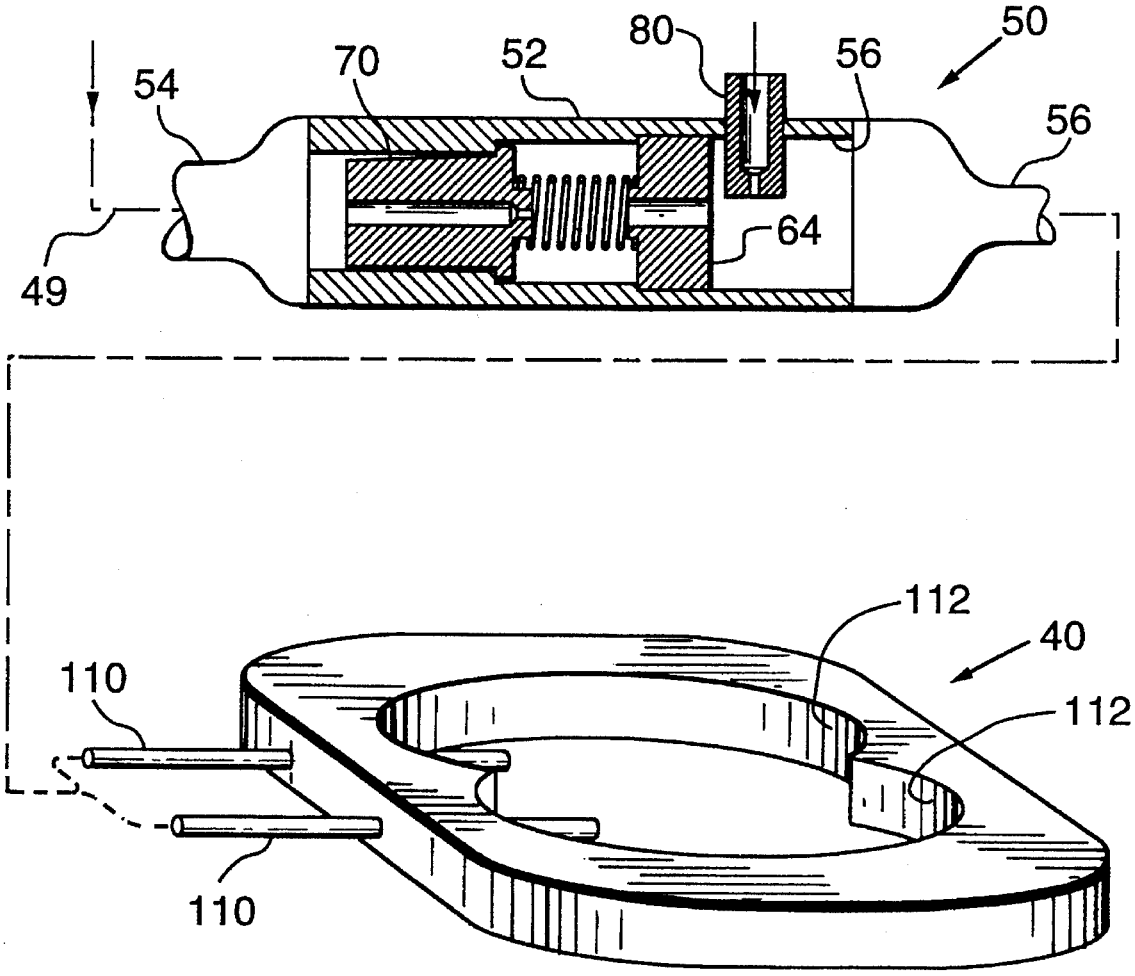
FIG. 4 is a schematic, part perspective view of a carburetor spacer plate with injection water inlet lines and the spray nozzle means of the invention.

Turning to FIGS. 2 and 4 the spray nozzle means 50 has a cylindrical body 52 with a water inlet 54 and an outlet 56.

An annular seat 58 receives valve body 60, held in seated relation thereon by coil spring 62.

The outlet end 56 has apertured retaining plate 64 secured therein. The plate 64 has discharge aperature 66 therethrough.

The substantially cylindrical upstream portion 68 of valve body 60 has a tapered side 70, in the form of a relieved "flat".

The hollow interior of valve body 60 terminates in a sized aperture 72 through which a jet of injection liquid (water) is discharged, into the downstream chamber 74.

The chamber 74 has a cylindrical wall 75, and accommodates spring 62.

Figure 3:
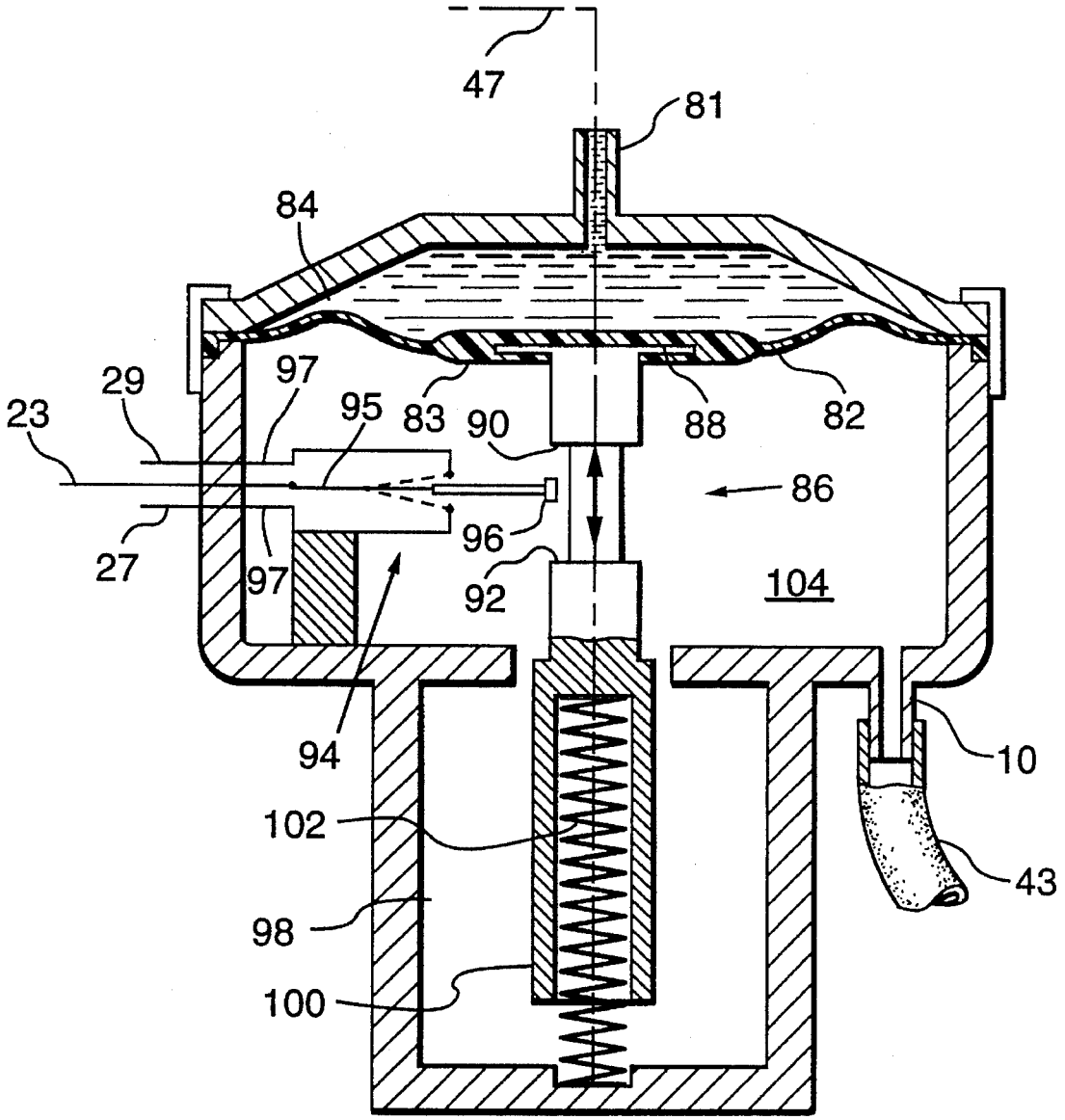
FIG. 3 is a side elevation in diametrical section of a vacuum driven pump, in accordance with the invention.

Referring to FIG. 3, the vacuum pump 24 has liquid (water) inlet/outlet 81 to which line 47 connects.

Flexible diaphragm 82 encloses liquid chamber 84. A push-pull rod 86 includes a flattened head portion 88, contained within a central boss 83 of diaphragm 82.

The rod 86 also has an upper annular shoulder 90 and a lower annular shoulder 92.

An electrical reed switch 94 has power lead 95 which connects with conductor 23; and two outlet leads 97 which connect by lines 27 and 29 respectively to the solenoid valve 26 and the electrical pump 28. The switch 94 has actuating knob 96 by which the shoulders 90 and 92 energize the respective lines 29 and 27. Thus the switch 94 energizes either the solenoid valve 26 or the electric pump 28.

The hollow spindle end 100 of rod 86 accommodates a coil spring 102.

The vacuum chamber 104 of vacuum pump 24 has connector 10 to which vacuum line 43 is connected, from the induction manifold connection 38.

The vacuum pump 24 commences to operate continuously, with operation of the engine 10, as soon as the temperature of coolant in radiator return hose 18 exceeds a predetermined minimum value, so as to close the thermal switch 16 and thereby energize the system.

In an initial liquid (water) filling mode, with the chamber 84 substantially emptied under the previous action of spring 102, the shoulder 92 is in its raised uppermost position. In this position the switch 94 is held in a first closed position, thereby resulting in the energizing of the electrical pump 28. In the first, "up" position of switch 94, (which is a closed position), the de-energized solenoid valve 26 connects the water line 45 to the line 47. The energized electrical pump 28 then delivers water to the water chamber 84 of vacuum pump 24. This action is supplemented by suction within vacuum chamber 104, working against the spring 102.

When the chamber 84 is full the rod 86 is displaced downwardly such that shoulder 90 actuates knob 96 downwardly, to move switch 94 to its second closed position, to energize the line 27, and hence the solenoid valve 26, which then connects line 47 to line 49, while de-energizing the electric pump 28. Then, under the action of the spring 100 the vacuum pump 24 discharges water to the spray nozzle means 50. The filling cycle normally takes about 5 to 10 seconds, and terminates with filling of the chamber 84.

The vacuum pump discharge cycle immediately following the completion of the filling cycle may last about 4 to 5 minutes under maximum water demand, full load engine conditions, the discharge being produced by the spring 102, as modified by manifold suction pressure.

When the chamber 84 is discharged, the brief liquid refill cycle takes place.

On shutting down the engine the ignition circuit is opened, and hence the energization of all circuits is terminated.

This then open-circuits the solenoid valve 26, which permits the discharge of water from the vacuum pump 24 by way of line 47, valve 26 and line 45, back to the reservoir 32, under the action of the spring 102.

Referring to FIG. 4, the spray nozzle means 50 is illustrated as being connected by bifurcated connections 110 with spacer plate 40 having siamesed bores 112, 112, therethrough for a twin-barrel carburettor 36.

In the case of fuel injected vehicles (either port injected or throttle body fuel injected) the water inlet is located below (downstream) of the butterfly throttles, such that the water injection rate is influenced by the butterfly air control or the air/fuel control, respectively.

In operation of the liquid injection cycle, when the force generated by water entering inlet 54 as modified by vacuum from the induction manifold 38, exceeds a predetermined value, sufficient to overcome the spring 62, the valve body 60 draws clear of seat 58, permitting a by-pass flow of water alongside the tapered side 70, past the seat 58 into the chamber 74.

Due to the taper of side 70, greater displacement of valve body 60 causes greater by-pass flow of the liquid.

An air bleeder nozzle 80 (see FIGS. 2 and 4 also) is set into the cylindrical wall of spray nozzle means 50.

The nozzle 80 is a push fit into the wall for convenience of replacement. The air bleeder nozzle 80 has a sized orifice 84 of a diameter in the range 15 to 35 thousanths of an inch by which a metered jet of air is admitted.

A pair of conduits 110 connect the outlet 56 of spray nozzle means 50 to the twin bores 112 of spacer plate 40.

The 2-barrel carburetor 36 discharges its approximately stoichimetric mix of air and fuel into the twin bores 86 of spacer plate 40.

The spray nozzle means 50 discharges its atomized mist of air and water into the bores 112, in mixing relation with the fuel/air mixture.

The diameter of air bleeder orifice 84, in the case of an actual 350 cubic inch 8-cylinder North American gasoline test engine, was within the size range 15 to 35 thousandths of an inch in diameter (15–35 mils), and preferably 15–25 thou-diameter.

Figure 5:
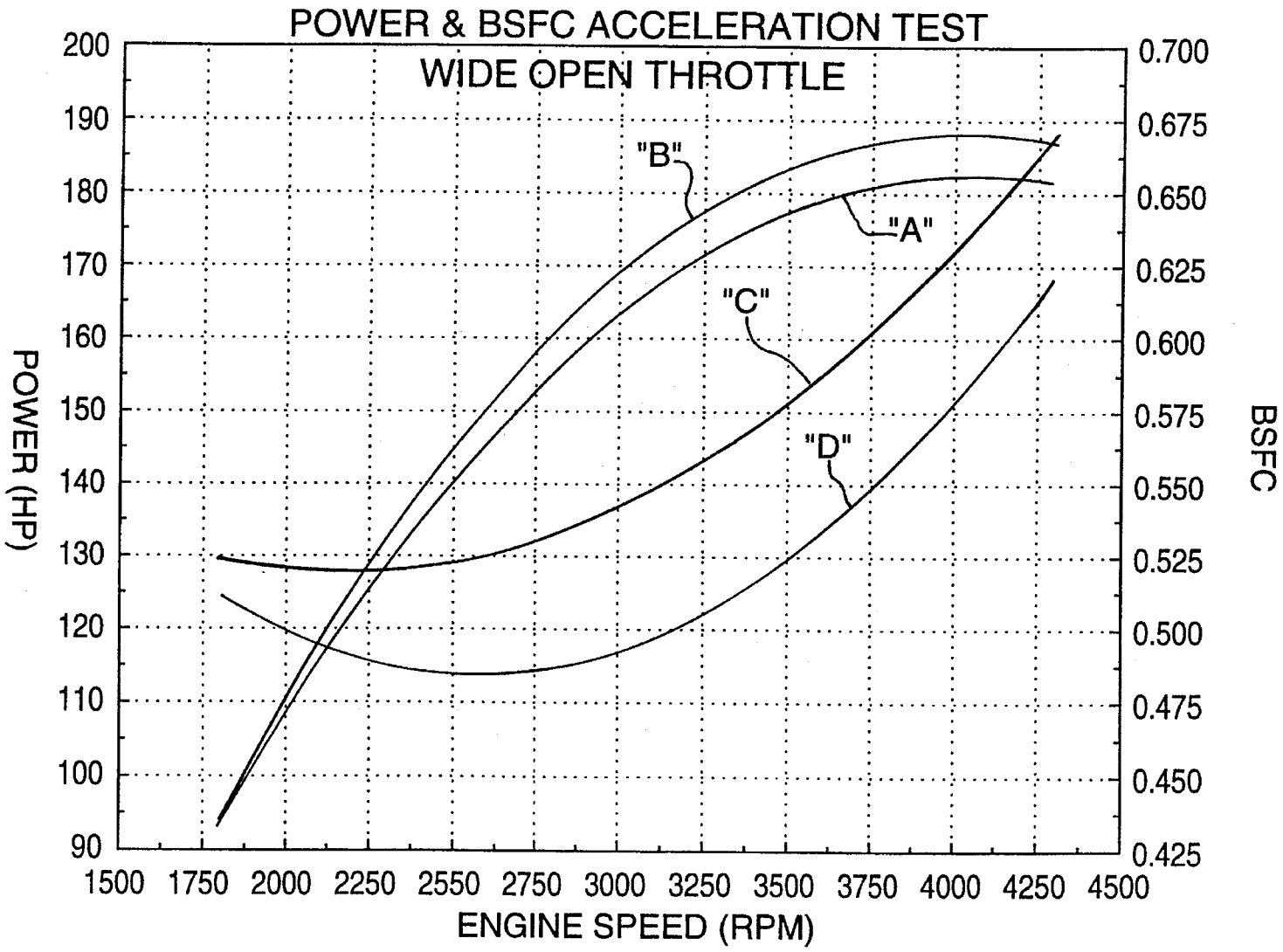
FIG. 5 is a graph showing the effects of the present water injection system on the power and fuel consumption characteristics of an actual engine.

Referring to FIG. 5, actual laboratory tests carried out using a load cell on a V-8 "standard" 350 cubic inch fuel injected North American engine, operating both without and with water injection according to the present invention have clearly demonstrated that significant enhancement of vehicle operation may be obtained using the presently disclosed system.

Thus, referring to FIG. 5, for the test engine working at full throttle the curve "A" represents actual horsepower output under standard, non-water injected conditions.

Curve "B" shows the enhanced horsepower characteristics with water injection according to the present invention.

Curve "C" represents Brake Specific Fuel Consumption for the test without water.

Curve "D" represents Brake Specific Fuel Consumption for the test using water injection according to the present invention.

It can be seen that a significant power increase may be obtained, using the present invention.

Also a significant improvement on fuel consumption is achievable.

A strip down inspection after test runs exceeding 100 hours showed no undue wear or damage.

COMMERCIAL APPLICABILITY

The present water injection system is practical in use and has potential world wide application.

What is claimed is:

1. A liquid injection control system for injecting a non-combustible liquid into the induction manifold of an internal combustion engine, said system having a spray nozzle means located externally of said engine for the passage of said injection liquid therethrough, said spray nozzle means having a liquid inlet, an orifice for passage of injection liquid therethrough;

an outlet for said liquid downstream of said orifice connecting with said manifold, an expansion chamber intermediate said orifice and said outlet, and an air nozzle having an inlet and an outlet, with said inlet located outside said spray nozzle means and with said outlet located within said expansion chamber, to admit atmospheric air to the chamber;

the main axis of said air nozzle being inclined from the main axis of said expansion chamber, whereby, in use, air leaving said air nozzle impinges laterally upon liquid leaving said orifice, in atomizing droplet forming relation therewith, to substantially atomize said injection liquid before passage thereof into said manifold.

2. The injection control system as set forth in claim 1, said spray nozzle means including variable by-pass valve means for the passage of a portion of said liquid in by-pass flow relation with said orifice.

3. The injection control system as set forth in claim 2, said variable by-pass valve means including a spring loaded variable orifice responsive to pressure of said liquid at said liquid inlet.

4. The injection control system as set forth in claim 3, said by-pass valve means having an annular valve seat, a substantially cylindrical valve body having a collar portion in seated sealing relation with said valve seat, and spring means regulating displacement of said valve body off said annular seat.

5. The injection control system as set forth in claim 4, said injection liquid orifice being located in said cylindrical valve body in substantially co-planar relation with said collar portion.

6. The injection control system as set forth in claim 4 in combination with liquid pumping means for transferring said injection liquid from a reservoir therefor to said spray nozzle liquid inlet.

7. The injection control system as set forth in claim 6, said liquid pumping means including electric pumping means.

8. A liquid injection control system in combination with an internal combustion engine having an inlet manifold; said injection control system including a reservoir for said injection liquid, spray nozzle means connecting with said manifold, and pumping means including an electric pumping means in use to transfer said injection liquid from said reservoir to said spray nozzle means at a rate of delivery regulated in response to variations in gaseous pressure within said manifold; said spray nozzle means having an inlet for said injection liquid, an orifice for the passage of the injection liquid therethrough, and a variable by-pass valve for the passage of a portion of said injection liquid in by-pass flow relation with said orifice; said by-pass valve having an annular valve seat, a substantially cylindrical body forming a variable, spring loaded orifice having a collar portion in seated sealing relation with said valve seat, and spring means regulating displacement of said valve body off said annular seat in response to pressure of said injection liquid;

said spray nozzle means having an outlet for said injection liquid downstream of said orifice, an expansion chamber between said orifice and said outlet, and an air nozzle having an inlet located outside said expansion chamber and an outlet located within said expansion chamber, the main axis of the air nozzle being inclined from the main axis of said expansion chamber, whereby, in use, air leaving said air nozzle impinges in atomizing, droplet forming relation upon liquid leaving said orifice.

9. The combination as set forth in claim 8, including flow control means for directing the passage of said injection liquid from said reservoir to said pumping means, and from said pumping means to said spray nozzle means.

10. The combination as set forth in claim 9, said flow control means comprising solenoid valve means;

said pumping means including vacuum pumping means having a diaphragm responsive to said gaseous pressure in deflected relation thereby, and electrical switch means responsive to deflections of said diaphragm, to selectively energize said solenoid valve means and said electrical pump means in response to the limiting positions of said diaphragm.

11. The combination as set forth in claim 10, said electric pump means serving to boost flow of injection liquid to said vacuum pumping means.

12. The combination as set forth in claim 8, said air nozzle being readily accessible externally of said spray nozzle means, to enable replacement thereof by an air nozzle of differing pre-calibrated size.

13. The combination as claimed in claim 12, said air nozzle having a pre-calibrated outlet aperture in the range 15 to 35 thousandths of an inch diameter.

* * * * *